United States Patent [19]

Hamm et al.

[11] 3,969,040

[45] July 13, 1976

[54] PUMP, ESPECIALLY CIRCULATING PUMP

[75] Inventors: Falko Hamm, Stuttgart; Günter Kratz, Plochingen, both of Germany

[73] Assignee: G. Bauknecht Gesellschaft mit beschrankter Haftung Electrotechnische Fabriken, Stuttgart, Germany

[22] Filed: Aug. 22, 1974

[21] Appl. No.: 499,566

[30] Foreign Application Priority Data

Aug. 23, 1973 Germany ..... 2342605

[52] U.S. Cl. ..... 417/292; 415/141

[51] Int. Cl.[2] ..... F04B 49/00

[58] Field of Search ..... 415/131, 140, 141; 417/292

[56] References Cited

UNITED STATES PATENTS

| | | | |
|---|---|---|---|
| 1,290,521 | 1/1919 | Crowhurst | 415/141 |
| 1,607,657 | 11/1926 | Whitehead | 417/292 |
| 2,245,632 | 6/1941 | Winkler | 415/141 |
| 2,768,585 | 10/1956 | Hardy | 417/292 |
| 3,689,200 | 9/1972 | Galis et al. | 417/292 |

FOREIGN PATENTS OR APPLICATIONS

| | | | |
|---|---|---|---|
| 657,574 | 5/1929 | France | 415/141 |

*Primary Examiner*—Wendell E. Burns
*Assistant Examiner*—David D. Reynolds
*Attorney, Agent, or Firm*—Walter Becker

[57] ABSTRACT

A pump, especially circulating pump, particularly for heating systems, which has a pump wheel rotatably but axially non-displaceably arranged within a housing which has two suction chambers arranged in axial direction of said pump wheel on opposite sides thereof while at least one pressure chamber likewise arranged in the housing extends around the pump wheel and its axis of rotation. The pump wheel has two suction openings located in the vicinity of its axis of rotation at opposite sides thereof while communicating with the respective adjacent suction chamber. The pump wheel also comprises vanes extending radially with regard to its axis of rotation and also comprises a central fluid receiving chamber establishing fluid communication between the two suction openings and adapted to convey fluid to the vanes, while a control member is displaceable in a continuous manner in the fluid receiving chamber in the axial direction of the pump wheel for controlling the inflow of fluid from the suction chambers into the fluid receiving chamber.

10 Claims, 1 Drawing Figure

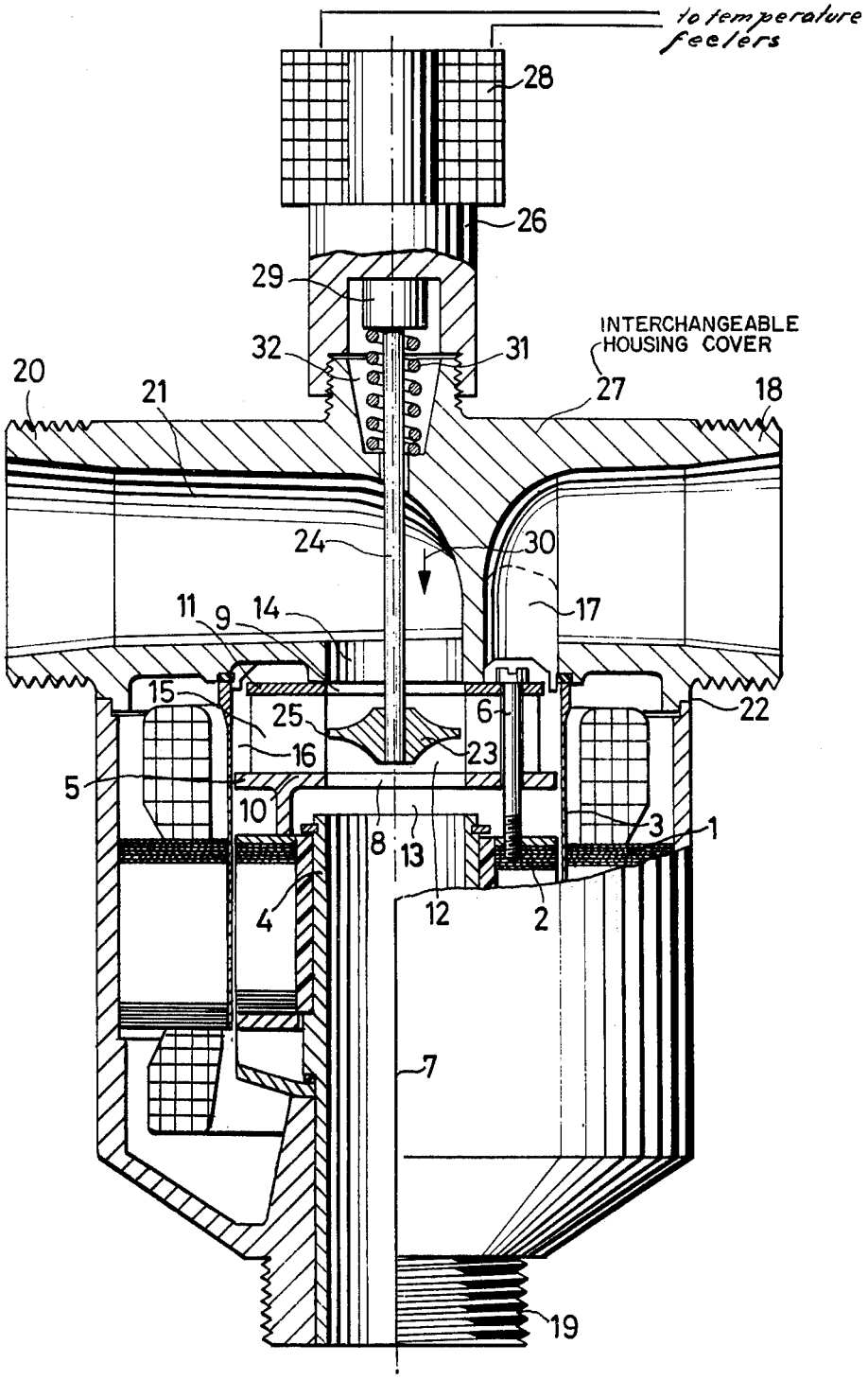
to temperature feelers
28
26
29
32
31
INTERCHANGEABLE HOUSING COVER
20
21
27
18
24
30
17
11
9
14
15
25
6
22
16
23
5
10
3
1
8
13
4
12
2
7
19

PUMP, ESPECIALLY CIRCULATING PUMP

The present invention relates to a pump, especially a circulating pump for a heating plant with a housing and with two suction chambers and with at least one pressure chamber and a pump wheel which accelerates radially outwardly the liquid to be delivered and which is equipped on both sides with one suction mouth each located in the vicinity of its axis of rotation. The invention more specifically relates to a pump of the type set forth, in which said pump wheel is arranged between the suction chamber and communicates through one suction mouth each with the respective adjacent suction chamber while a controlling element displaceable in the direction of the axis of rotation of said pump wheel is provided for controlling the division or distribution of the quanity of the fluid to be drawn from the two suction chambers.

A pump of the above mentioned type has become known as circulating pump for a central heating plant and is disclosed in German Offenlegungsschrift 21,07,000. With such central heating plants it is customary to provide a mixing valve by means of which relatively cool return water from the heating bodies or radiators can be admixed to the hot water coming from the boiler so that independently of the adjusted temperature of the boiler the heating of the heating bodies or radiators can be controlled. The heating up is all the lower the more water from the return line of the heating body system is admixed to the hot boiler water and is pumped anew through the heating body system.

With this heretofore known pump, the additional expenses for such mixing valve are reduced by the fact that the admixing of cooler return water to the boiler water is controlled by the pump itself. To this end, one suction chamber of the known pump is connected to the delivery line of the boiler whereas the other suction chamber is connected to the return line from the heating body system, while between both suction chambers there is arranged a turbine pump wheel provided with blades on both sides and adapted to accelerate the fluid radially outwardly into the pump pressure chamber. The turbine pump wheel itself acts as control element for distributing the quantities to be drawn from the two suction chambers. To this end, the said pump wheel is displaceable in the direction of its axis of rotation. By means of the hydraulic forces acting during the delivery of said pump wheel, the latter is pressed into a control end position in which one of the two suction chambers is blocked off by a cylindrical outer surface of the wheel, whereas the blades on the other side of the wheel deliver from the other suction chamber. By means of a magnet built into the pump, the pump wheel is adapted in response to exciting the magnet to be pulled into the other control end position in which reversely the other suction chamber is closed off and a delivery takes place only from the first suction chamber by means of the pump blades on the adjacent wheel side to said first suction chamber.

Thus, with this known pump, a continuous admixture of return water to the hot boiler water is not possible. Instead either boiler water alone can be fed or when exciting the magnet, return water alone will be fed, which fact brings about a disadvantageous discontinuous withdrawal of hot water from the boiler and makes it difficult to regulate the room temperature to a certain desired valve in view of the fact that the heat body temperature is subjected to strong variations and thus in view of the inertia of the control system due to the slowly occurring temperature changes causes considerable variations in the control factor in the respective chamber or room.

The above drawback cannot be taken care of by the known pump even if instead of the two discrete control positions of the pump wheel, its continuous displacement over the control distance is provided in order in this way by a simultaneous delivery of partial flows to obtain a continuous mixture of the quantities to be drawn in on both sides of the pump wheel. It will be appreciated that such intake of partial quantities from the respective suction chambers would bring about a disadvantageous change in the characteristic of the pump because the flow resistance with a gradual control of the connecting opening to a suction chamber will noticeably increase in view of tolerance losses and the turbine wheel would with a throttling of the intake cross section work with an unfavorable degree of efficiency. Germany Offenlegungsschrift 19,42,647 discloses a circulating pump which simultaneously takes over the function of a mixing valve and permits a continuous admixture of return water to the heating water from the boiler feeding line while said pump operates independently of the mixing ratio always with an optimum degree of effeciency. To this end, with this known pump an additional housing part is provided in the axial direction ahead of the pump wheel. This housing part is designed in the manner of a separate mixing valve. The two suction lines with hot water from the boiler and cool water from the return line of the heating body system lead into the interior of this additional housing part within the region of a control body displaceably arranged between the mouth of said two suction lines, which control body controls the exit of partial flows into an antechamber of the pump wheel by a continuous control of the outflow cross sections. From this antechamber, the mixed fluid flows to the pump wheel and is fed into the feeding line to the heating box.

With this construction, merely the mixing valve is included in the pump housing. While this reduces the space requirement, it does not reduce the manufacturing costs. To the contrary, to so include the mixing valve in the pump housing causes major structural and manufacturing problems than the functionally equivalent separate arrangement of the mixing valve adjacent the pump housing.

In an effort to overcome the above mentioned drawbacks, it is an object of the present invention to provide a pump of the above mentioned general type which without noticeably affecting the degree of efficiency of the pump will make possible a continuous mixture of partial quantities of fluid withdrawn from the two suction chambers.

This and other objects and advantages of the invention will appear more clearly from the following specification in connection with the accompanying drawing diagrammatically illustrating a vertical section of a circulating pump according to the invention.

The circulating pump according to the invention is characterized primarily in that the pump wheel is non-displaceably mounted relative to the housing and in the vicinity of the axis of rotation of said pump wheel includes a feeding chamber for the blades which feeding chamber interconnects the suction mouths of the two suction chambers while the control member is continuously displaceably arranged in said feeding chamber and for purposes of distributing the quantities of drawn-in fluid substantially covers the cross section of the feeding chamber.

Thus, from both lateral suction chambers, feeding fluid flows into the common feeding chamber so that the blades of the pump wheel always feed the same quantity of fluid. Depending on the position of the control element in the feeding chamber, the delivery is effected primarily from one or the other suction chambers, however always under the flow conditions for the vanes or blades. Due to the common delivery of the partial flows by means of the wheel blades, an intimate intermixture takes place in the pressure chamber which intermixture is available for use in the pressure line of the pump.

Referring now to the drawings in detail, the arrangement shown therein represents a circulating pump which is driven by a collimator motor (Spaltrohrmotor). The stator 1 of the pump is sealed relative to the rotor 2 by means of a collimator 3. The rotor is rotatably journaled on a plug shaft 4 which is unilaterally fixed in the housing and which at its end face is connected to pump wheel 5 by means of connecting screws 6.

Within the region of its axis of rotation 7 the pump wheel 5 has at both sides thereof a suction mouth 8 and 9 respectively in the form of a circular opening provided in a pertaining flange 10, 11 of the wheel 5. Between the two suction mouths 8 and 9 there is provided a feeding chamber 12 free from rotating inserts for the passage of fluid to be conveyed from the adjacent suction chambers 13 and 14 to the blades 15 of wheel 5.

The blades 15 extend radially with regard to the axis of rotation 7 of wheel 5 so that independently of the direction of rotation of said wheel 5 fluid is conveyed from the chamber 12 radially outwardly into an annular pressure chamber 16 from where the fluid passes into a pressure line 17 of the pump wheel 5. From here the conveyed fluid passes into a conveying line connectible to a pressure connection 18. In case of employing the pump as circulating pump in a heating plant, said conveying line represents the line or lines leading to the heating bodies.

Feeding lines for instance the lines feeding the boiler water or the return lines of the heating installation are adapted to be connected to further connections 19 and 20 of the pump. In this instance it is immaterial which of the two connections 19 or 20 is selected for the respective line.

The supply of fluid from the connnection 19 is effected centrally along the axis 7 of the wheel 5 through the cylinder inner chamber of the plug axle 4 whereby a particularly compact construction will be realized because within the region of the wheel 5 and the rotor 2, no space for a laterally extending suction line to the suction chamber 14 will be required. From the connection 20, the fluid passes through a suction line 21 to the suction chamber 14. Due to the fact that the connection sections 18 and 20 may be arranged at the same level, the pressure line 17, the suction line 21 and the suction chamber 14 may be provided in a one-piece housing cover 27 prepared as a die cast piece. The housing cover 27 is centered on a circular separating gap 22 on a cylindrical housing part which surrounds the motor and the pump wheel.

In order to be sure that the blades 15 of the pump wheel 5 will through the feeding chamber 15 not uniformly from both adjacent suction chambers 13 and 14 feed fluid, a control member 23 is provided in the interior of the feeding chamber 12 which substantially covers up the cross section of said chamber 12. The control member 23 is connected to a control rod 24 which is mounted in the cover portion of the housing. By means of control rod 24, the control rod 23 is displaceable in the direction of the axis of rotation 7 of the wheel 5. The control member 23 is designed in the form of a disc which substantially covers up the cross section of the feeding chamber 12 and which depending on its position in the chamber 12 will free a major feed opening of the suction chamber 13 or the suction chamber 14 while simultaneously reducing the cross sectional in-flow of the respective other suction chamber correspondingly so that vanes or blades 15 will always operate with full delivery power. For purposes of obtaining a favorable flow deviation, the control element 23 designed as disc is rotation-symmetric with regard to the wheel axis 7 and has radially outwardly declining surfaces so that at the circumference of the disc a relatively thin rim 25 is obtained which safeguards an unimpeded oncoming flow of fluid to the wheel blades 15.

The blades 15 extend radially with regard to the axis of rotation 7 so that independently of the axis of rotation of the wheel 5 always the same favorable conveying conditions are prevalent.

The control mechanism for the setting of the desired position of control element 23 in the interior of the chamber 12 is provided on or in the upper part 26 of the housing cover 27. The adjusting movement of the control bar 24 is with the illustrated embodiment effected by a well-known design of an expansion element. This expansion element includes a coil 28 which is in communicaton with an outer or inner temperature feeler and is controlled by the latter. The coil 28 receives a current which is of a magnitude that depends on the temperature conveyed by the outer or inner temperature feeler and which generates a certain heat in the coil. This coil heat is conveyed to an expansion material which expands correspondingly while this expansion movement moves an adjusting piston 29 in the direction of the arrow 30. Depending on the outer temperature, the adjusting piston 29 with control member 23 is brought into a certain position by means of which the admixture is controlled as to its magnitude. The return setting of the control rod 24 is effected by a pressure spring 31 which on one hand rests against the housing cover 27 and on the other hand rests against a collar of the piston 29.

The adjusting movement of the control rod 24 may however also be effected in a different way, for instance by a rotary magnet, a lifting magnet, or an adjusting motor.

It is furthermore possible to control the adjusting movement of control rod 24 directly by the returning heating water. In such an instance which is not illustrated in detail in the drawing, the housing of the expansion element is without coil 28 arranged directly in the flow of the returning heating water.

For purposes of effecting a simple changeover forming a pump according to the drawing with suction line 21 and pressure line 17 in the housing cover 27 to a normal design of such pump according to which the housing cover merely has the pressure connection for the pressure line it is provided according to the invention that the housing cover illustrated in the drawing with suction and pressure line can without other changes, in a simple manner, be changed having a housing cover only with pressure line of normal design of such pump at any desired time. In this way, the pump base unit can be employed for two different cases of employment of the pump, namely for one with remote control and for one with this same admixture according to the invention. To this end it is merely necessary to employ the respective necessary cover design adapted to the corresponding purpose of employment. Consequently a pump of the illustrated type can in a simple manner also be changed into a pump without admixture. Inversely, a pump of a normal desing can be converted into a mixing control pump according to the invention.

It is, of course, to be understood that the present invention is, by no means, limited to the particular showing in the drawing but also comprises any modifications within the scope of the appended claims. It is furthermore to be understood that the pump according to the invention is not limited for use in heating installations but may also be employed for other mixing purposes.

What we claim is:

1. A pump, especially circulating pump, which includes: housing means; a pump wheel rotatably but non-displaceably arranged within said housing means: said housing means comprising two suction chambers arranged in axial direction of said pump wheel and respectively located on opposite sides of said pump wheel, said housing means also comprising at least one pressure chamber extending around said pump wheel and its axis of rotation; said pump wheel having two suction openings located in the vicinity of the axis of rotation of said pump wheel and at opposite sides thereof while communicating with the respective adjacent suction chamber; said pump wheel also comprising vanes extending radially with regard to said axis of rotation of said pump wheel and also comprising a substantially central fluid receiving chamber establishing fluid communication between said two suction openings and adapted to convey fluid to said vanes; and a control member having a circumferential contour and size approximately corresponding to the circumferential contour and size of said suction openings and being displaceable in a continuous manner in said fluid receiving chamber in the axial direction of said pump wheel for controlling the inflow of fluid from said suction chambers through the respective suction openings into said fluid receiving chamber, a plug axle arranged in said housing means and having an axial bore with an outer mouth for connection to a fluid supply and with an inner mouth leading to one of said suction chambers.

2. A pump according to claim 1, in which said control member is formed by a disc having its maximum extension along a plane transverse to the axis of rotation of said pump wheel.

3. A pump according to claim 2, in which said control member has a hub portion and is rotation-symmetric with regard to the axis of rotation of said pump wheel and the thickness of said control member decreases from said hub portion toward the preiphery of said control member.

4. A pump according to claim 1, which includes a housing cover having a first connection or connection to a suction line and a second connection for connection to a pressure line, said first connection communicating with said central fluid receiving chamber, and said second connection communicating with said pressure chamber.

5. A pump which includes: housing means; a pump wheel rotatably but axially non-displaceably arranged within said housing means; said housing means comprising two suction chambers arranged in axial direction of said pump wheel and respectively located on opposite sides of said pump wheel, said housing means also comprising at least one pressure chamber extending around said pump wheel and its axis of rotation; said pump wheel having two suction openings located in the vicinity of the axis of rotation of said pump wheel and at opposite sides thereof while communicating with the respective adjacent suction chamber; said pump wheel also comprising vanes extending radially with regard to said axis of rotation of said pump wheel and also comprising a substantially central fluid receiving chamber establishing fluid communication between said two suction openings and adapted to convey fluid to said vanes; and a control member having a circumferential contour and size approximately corresponding to the circumferential contour and size of said suction openings and being displaceable in a continuous manner in said fluid receiving chamber in the axial direction of said pump wheel for controlling the inflow of fluid from said suction chambers through the respective suction openings into said fluid receiving chamber, a housing cover having a first connection or connection to a suction line and a second connection for connection to a pressure line, said first connection communicating with said central fluid receiving chamber, and said second connection communicating with said pressure chamber, said first and second connection are arranged at substantially the same level, and in which said housing cover consists of a single die cast metal piece.

6. A pump according to claim 5, in which said housing means includes a housing cover, and a control rod connected to said control member and reciprocally guided in said housing cover.

7. A pump according to claim 6, which includes an expansion element operatively connected to said control rod.

8. A pump which includes: housing means; a pump wheel rotatably but axially non-displaceably arranged within said housing means; said housing means comprising two suction chambers arranged in axial direction of said pump wheel and respectively located on opposite sides of said pump wheel, said housing means also comprising at least one pressure chaamber extending around said pump wheel and its axis of rotation; said pump wheel having two suction openings located in the vicinity of the axis of rotation of said pump wheel and at opposite sides thereof while communicating with the respective adjacent suction chamber; said pump wheel also comprising vanes extending radially with regard to said axis of rotation of said pump wheel and also comprising a substantially central fluid receiving chamber establishing fluid communication between said two suction openings and adapted to convey fluid to said vanes; and a control member having a circumferential contour and size approximately corresponding to the circumferential contour and size of said suction openings and being displaceable in a continuous manner in said fluid receiving chamber in the axial direction of said pump wheel for controlling the inflow of fluid from said suction chamber through the respective suction openings into said fluid receiving chamber, said housing means including a housing cover, and a control rod connected to said control member and reciprocally guided in said housing cover, an expansion element operatively connected to said control rod, said expansion element includes a coil arranged in said housing means and provided with means for electric connection with temperature feeler means.

9. A pump according to claim 5 in which said housing cover is provided with a pressure conduit and a suction conduit and as an entirety is releasably secured to said housing means as to replacement by a housing cover with a pressure conduit only.

10. A pump according to claim 1 in which said housing cover is provided with a pressure conduit and a suction conduit and as an entirety is interchangeable for replacement by a housing cover with a pressure conduit only.

* * * * *